United States Patent [19]

Dupuis

[11] Patent Number: 4,903,605

[45] Date of Patent: Feb. 27, 1990

[54] AIR MISSILE PROVIDED WITH AT LEAST ONE RELEASABLE POWER UNIT

[75] Inventor: Jean M. Dupuis, Verrieres Le Buisson, France

[73] Assignee: Aerospatiale Societe Nationale Industrielle, Paris, France

[21] Appl. No.: 322,902

[22] Filed: Mar. 14, 1989

[30] Foreign Application Priority Data

Mar. 30, 1988 [FR] France ..... 88 04213

[51] Int. Cl.[4] ..... F42B 15/00

[52] U.S. Cl. ..... 102/377; 244/58; 244/63

[58] Field of Search ..... 102/377, 378; 244/58, 244/63, 3.22, 3.21; 60/225

[56] References Cited

U.S. PATENT DOCUMENTS

| | | | |
|---|---|---|---|
| 2,899,898 | 8/1959 | Goss | 102/377 |
| 3,190,221 | 6/1965 | Gariboldi | 102/377 |
| 3,260,204 | 7/1966 | Wilkey | 244/3.22 |
| 3,262,266 | 7/1966 | Howison | 102/377 |
| 3,310,947 | 3/1967 | Shryock | 60/225 |
| 4,348,956 | 9/1982 | Schmidlin | 102/377 |
| 4,628,821 | 12/1986 | Madderre et al. | 102/377 X |
| 4,745,861 | 5/1988 | Fenton et al. | 102/377 |

FOREIGN PATENT DOCUMENTS

| | | |
|---|---|---|
| 572824 | 3/1959 | Canada . |
| 1122380 | 8/1962 | Fed. Rep. of Germany . |

*Primary Examiner*—Deborah L. Kyle
*Assistant Examiner*—Michael J. Carone
*Attorney, Agent, or Firm*—Fisher, Christen & Sabol

[57] ABSTRACT

This invention relates to an air missile comprising at least one temporary, releasable power unit, connected to the rest of said missile by a fit capable of allowing said power unit to slide parallel to its axis in the direction opposite said rest of the missile, wherein a communication is established between, on the one hand, the space inside said fit and disposed between the front of said power unit and said rest of the missile, and, on the other hand, the aerodynamic flow around said missile. The invention is more particularly applicable to the natural separation of said power unit from the rest of said missile.

8 Claims, 2 Drawing Sheets

Fig: 1
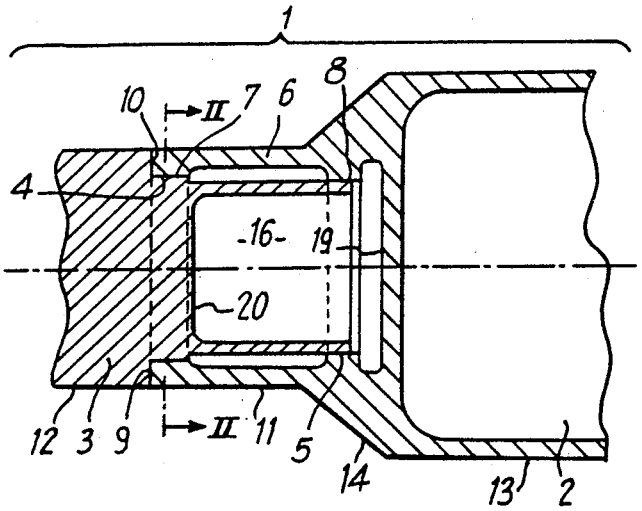
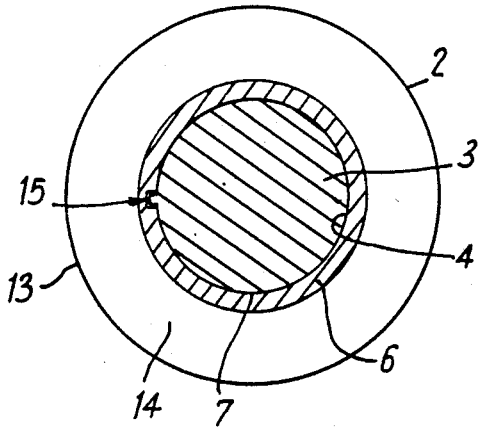
Fig: 2
Fig: 3
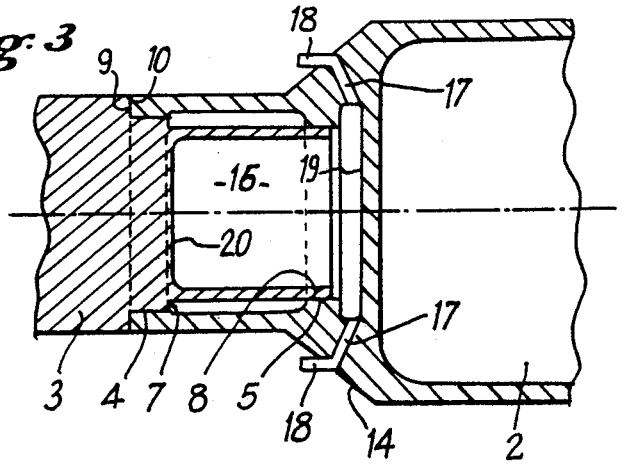

AIR MISSILE PROVIDED WITH AT LEAST ONE RELEASABLE POWER UNIT

FIELD OF THE INVENTION

The present invention relates to an air missile provided with at least one releasable power unit. It is applicable to any missile, such as missile, rocket, . . ., whether such power unit(s) is (are) mounted coaxially to said missile, or disposed on the periphery thereof. Such releasable power units are for example consumable accelerators intended to communicate to said missile a desired speed value.

BACKGROUND OF THE INVENTION

Essentially two methods are known for separating such a power unit from the rest of the missile, after it has performed its function.

The first, which may be qualified as active, employs mechanical or pyrotechnical elements, such as cutter cords, explosive bolts, extraction springs, etc. . ., controlled by a logic device. Such active separation systems are therefore complex. In addition, their reliability is not perfect.

The second of said methods is called natural, as separation is effected spontaneously under the action of the aerodynamic drag of said power unit.

In missiles provided to employ such a natural separation, the power unit is connected to the rest of the missile by a precise fit, constituting a sliding connection parallel to the axis of said power unit, but rendering the latter fast in rotation with said missile.

In this way, upon launching of the missile and during its flight under the action of said power unit, the force of propulsion of the latter, reinforced by the aerodynamic drag of the rest of the missile and by the forces of friction of the sliding connection, but reduced by the aerodynamic drag of said power unit, ensures connection of the power unit on said missile.

On the other hand, at the end of operation of said power unit, said force of propulsion decreases very considerably (thrust decay) until it is canceled, with the result that it becomes insufficient to maintain said power unit fast with the rest of the missile. The aerodynamic drag of said power unit may then overcome the forces of friction of the sliding connection and, against the action of the aerodynamic drag of the rest of the missile, said power unit separates naturally from the rest of the missile.

Such a natural method of separation therefore presents considerable advantages of simplicity, both in production and in carrying out. However, it also presents considerable drawbacks, associated with the fact that the forces that it brings into play are difficult to master.

In fact, the forces of friction in a sliding connection depend on the state of the contact surface, the possible lubrication and on the clearance, i.e. the manufacturing tolerances of the fit of the power unit on the rest of the missile. Moreover, a phenomenon of gumming may appear, when the sliding connection is immobilized for a prolonged period of time, for example munitions in store.

Furthermore, the sliding connection which ensures rigidity of the assembly of the missile and the power unit, may be subjected to a considerable restraining moment during separation. This moment, which may result from the aerodynamics of the missile or from longitudinal mechanical vibrations, considerably affects the level of the forces of friction. Finally, the immobilization of the sliding connection in rotation may contribute additional frictions due to torsional couples (likewise of aerodynamic or vibratory origin) in the fit.

As to the forces of propulsion of the power unit at thrust decay, they too are not well known, like the aerodynamic forces and, more particularly, their distribution between the missile and the power unit.

In addition, the aerodynamic drag of the power unit, the only force on which one counts for separation and which is desirably great in order to promote separation, must, of course, be as reduced as possible for reasons of economy.

A certain number of uncertainties therefore appear, relative to the level of the forces employed in natural separation. Such incertainties are translated by a very considerable dispersion of the instant of separation. Such a separation may, in certain cases, not even occur at all. In any case, the subsequent flight program of the missile is much disturbed thereby. The method of natural separation, although very attractive, therefore involves operational contingencies which are difficult to accept, particularly for a modern weapon system.

In order to overcome these drawbacks, various improvements have been envisaged, consisting in introducing new forces propitious to separation, such as those generated by the opening of a braking parachute or by extraction springs provided in the sliding connection.

However, such arrangements require a logic for triggering and the above-mentioned drawbacks concerning the active method of separation are reintroduced. Moreover, it is already no longer question of natural separation.

It is an object of the present invention to overcome these drawbacks. It enables a temporary power unit to separate naturally from the rest of a missile, safely, without employing controllable auxiliary devices.

SUMMARY OF THE INVENTION

To that end, according to the invention, the air missile comprising at least one temporary, releasable power unit, connected to the rest of said missile by a fit capable of allowing said power unit to slide parallel to its axis in the direction opposite said rest of the missile, is noteworthy in that a communication is established between, on the one hand, the space inside said fit and disposed between the front of said power unit and said rest of the missile, and, on the other hand, the aerodynamic flow around said missile.

In this way, this internal space is placed under a pressure equal at least to part of the total pressure of said aerodynamic flow, with the result that, in this internal space is generated a force favourable to the natural separation of the power unit.

Such an internal space generally exists by construction between said power unit and the rest of the missile. Of course, in the event of it not existing, it would be necessary to arrange it especially with a view to carrying out the invention.

In order not to disturb the aerodynamics of the rest of the missile by the arrangement of outside pressure tappings, it is preferable if said communication be established through said power unit. In fact, since the latter is generally intended only to propel said missile during launching thereof and on the initial part of its path before being released, it is less disturbing if it is the aerodynamism of said power unit which is altered by said communication. Moreover, such pressure tappings increase the aerodynamic drag and it is therefore preferable to dispose them on the power unit, since, in that case, they promote separation thereof.

When, as is current, said power unit has a diameter larger than that of the part of said missile on which it is mounted and when said part is connected to said power unit by a divergent wall joined thereto, it is preferable if said communication is established through said divergent wall. In this way, when said communication is constituted by at least one conduit, the outer orifice thereof is advantageously directed towards the front of said missile, so that the inlet of air is promoted.

Said communication is preferably multiple.

In an advantageous embodiment, the communication conduit is extended outside said missile by an air vent. In that case, it is preferable if said air vent is at least substantially parallel to the axis of the missile and directed towards the front thereof.

Of course, in the event of said communication being multiple, it is preferable if the aerodynamic symmetry of the assembly is respected. The manner of disposing the air vents, in order to recuperate the desired pressure, then takes into account the presence of possible shock waves in supersonic flow.

BRIEF DESCRIPTION OF THE DRAWINGS

The invention will be more readily understood on reading the following description with reference to the accompanying drawings, in which:

FIG. 1 is a schematic, partial view, in axial section, of an embodiment of a missile to which the invention may be applied.

FIG. 2 is a transverse section along line II—II of FIG. 1.

FIG. 3 is a view similar to FIG. 1, illustrating the present invention.

In these Figures, identical references designate like elements.

DETAILED DESCRIPTION OF THE DRAWINGS

Figure 4:
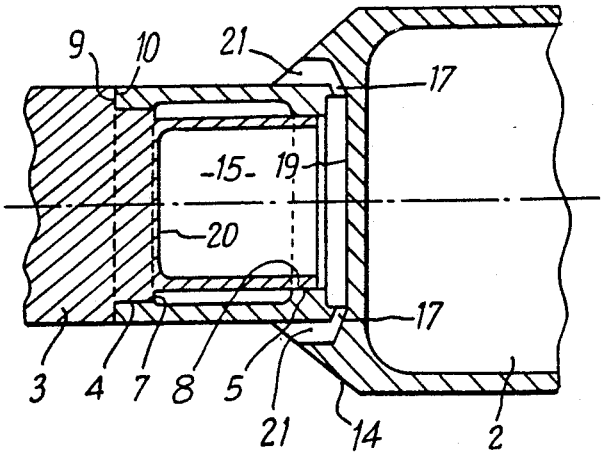
FIG. 4 illustrates a variant embodiment of the invention, in a view similar to that of FIG. 3.

Referring now to the drawings, FIGS. 1 and 2 schematically show, in partial section, a missile 1 comprising a temporary power unit or accelerator 2 (for example employing powder), of which the front part is mounted on the rear part of the rest 3 of said missile. In this embodiment, it has been assumed that the accelerator 2 was coaxial to the rest 3 of said missile, but it is clear that this particular feature is not essential for the invention. For example, the axis of the accelerator 2, whilst being parallel to the axis of said missile, might be eccentric with respect thereto. In that case, the front part of the accelerator is not forcibly connected to the rear end part of the rest 3 of the missile 1. In FIGS. 1 and 2, it has been assumed in addition, and this is likewise not compulsory, that the diameter of the accelerator was larger than that of the rest 3 of the missile 1.

In the embodiment shown, the rear part of the rest 3 of said missile (rest which might possibly comprise another accelerator) is provided with two cylindrical bearing surfaces 4 and 5 which are coaxial and stepped. The front part of the accelerator 2 comprises a cylindrical portion 6, provided with inner cylindrical surfaces 7 and 8, adapted respectively to abut on the cylindrical bearing surfaces 4 and 5. A transverse shoulder 9 of the rear part of the rest 3 of the missile 1 cooperates with the front end edge 10 of the cylindrical portion 6 in order to serve as forward stop for the accelerator 2.

The fit between bearing surfaces 4 and 5 and the cylindrical surfaces 7 and 8 is tight and, when said cylindrical surfaces are in abutment on said bearing surfaces and the end edge 10 is in abutment against the shoulder 9, the outer contour 11 of the cylindrical portion 6 constitutes the extension of the outer contour 12 of the rear part of the rest 3 of the missile 1.

The outer contour 11 is furthermore joined to the outer contour 13 of the accelerator 2 by a conical skirt 14.

A longitudinal groove and rib system 15 renders the accelerator 2 and the rest 3 of the missile 1 fast with each other in rotation.

Between the rear parts of the rest 3 of the missile 1 and the front part of the accelerator 2, within the cylindrical portion 6, there is formed a closed inner space 16.

FIG. 3 shows the missile 1 of FIGS. 1 and 2, improved in accordance with the present invention. As may be seen, according to the invention, the inner space 16 is in that case placed in communication with the outside by one or more conduits 17, provided with outer air vents 18. In the example shown, the conduits 17 and the air vents 18 are arranged in the conical skirt 14. The air vents 18 are disposed at least substantially parallel to the axis of the power unit and directed towards the front of said missile 1.

In this way, upon launching of the missile 1 or during flight thereof under the action of the accelerator 2, the thrust of the latter acts so as to press the end front edge 10 of said accelerator 2 against the shoulder 9. Said accelerator 2 is therefore longitudinally fast with the rest 3 of the missile 1. Moreover, by the longitudinal rib and groove system 15, it is fast therewith in rotation.

The action of the thrust of the power unit 2 is then reinforced by the aerodynamic drag exerted on the rest 3 of the missile 1, and by the forces of friction existing respectively between the bearing surfaces 4 and 5 and the cylindrical surfaces 7 and 8. On the other hand, such action is countered by the aerodynamic drag exerted on the accelerator 2 and by the force due to the pressure prevailing in the inner space 16. In fact, the air vents 18 and the conduit 17 make it possible to transmit to the latter at least part of the aerodynamic overpressure prevailing in the vicinity of the missile 1 in flight.

In this way, when the accelerator comes to the end of its operation, its thrust decreases considerably, whilst the speed of the missile is high. Consequently, the force due to the overpressure in the inner space 16 may, assisted by the aerodynamic drag of the accelerator 2, overcome the action of the forces tending to maintain the accelerator 2 fast with the rest 3 of said missile 1. The front end edge 10 separates from the shoulder 9 and the surfaces 7 and 8 slide rearwardly on bearing surfaces 4 and 5, being guided longitudinally by the rib and groove system 15. The accelerator may continue this rearward movement until it separates completely from the rest 3 of the missile 1.

In order to improve the action of the force due to the overpressure within the inner space 16, it may be provided to dispose a sealing lubricant between the bearing surfaces 4 and 5, on the one hand, and the cylindrical surfaces 7 and 8, on the other hand. In this way, untimely leakages of fluid at those levels are avoided, as long as a part of said cylindrical surfaces 7 and 8 remains in contact with said bearing surfaces 4 and 5.

The volume of the inner space 16 and the diameter of the conduits and vents 17, 18, are dimensioned so that the level of the pressure forces remains as long as missile and accelerator are in contact during the phase of separation. The diameter of the inner space 16 determines in part the level of the pressure forces.

It will be noted that the total pressure (static and dynamic), function of the speed of flow, is transmitted to the inner space 16. This pressure is exerted both on the front face 19 of the accelerator 2 and on the base 20 of the rest 3 of the missile 1. It develops on the front of the accelerator a force tending to brake it and, on the rear of the missile, a force tending to eject it from the fit 4,7-5,8-9,10. These forces, by their very origin, are of the order of magnitude of the forces of drag intervening by their difference in the balance of the forces favourable to separation. However, it is their sum which is added to this balance of forces. This results in a very dynamic relative movement of the rest 3 of the missile 1 with respect to the accelerator 2, which occurs from the beginning of the thrust decay of acceleration of the latter.

In the variant embodiment of FIG. 4, the projecting air vents 18 have been eliminated and replaced by air vents 21 opening flush with the skirt 14.

The invention makes it possible considerably to increase the reliability of natural separation. The latter is in fact systematic, due to the added forces. Moreover, the rapidity of the relative movement of separation eliminates any risk of shock between the rest 3 of the missile 1 and the accelerator 2, after separation of the fit 4,7-5,8-9,10. In addition, the instant of separation is now subjected only to the dispersions inherent to propulsion, i.e. to the time of combustion of tee acceleration power unit 2.

The cost of this gain in reliability is virtually zero, being given the simplicity in carrying out the invention. There is neither increase in weight, nor mechanical parts in movement, nor control of operation or of setting before the missile 1 is fired. Entirely static and inert, the device of the invention is obviously very reliable.

Moreover, since the role of the drag of the power unit 2 is no longer preponderant in the separation, such drag may be voluntarily reduced, for example by decreasing the diameter of the accelerator or aerodynamically improving the contour thereof. This results in a saving in weight and in the energy of propulsion.

Furthermore, if a longitudinal locking device (not shown) were provided between the accelerator 2 and the rest 3 of the missile, it is seen that the pressure within the inner space 16 may be used for unlocking said locking device from the sliding connection 4,7-5,8 in flight, after firing.

The present invention is, of course, applicable to embodiments other than the one shown in the Figures. Various fits of the type described may be used, with variable guiding surfaces, depending on the desired control during extraction and the moments of fit to be endured during flight.

What is claimed is:

1. Air missile, comprising:

a temporary releasable power unit (2);

a sliding friction fit connecting the front part of said power unit (2) to the aft part of the rest (3) of said missile, said sliding friction fit ensuring, on the one hand, the connection of said power unit on said rest of the missile as long as the force of propulsion generated by said power unit, added to the friction action of said sliding fit and to the aerodynamic drag of said rest of the missile, overcomes the aerodynamic drag of said power unit, and, on the other and, the sliding separation of said power unit from said rest of the missile, when the aerodynamic drag of said power unit overcomes said force of propulsion added to said friction action of said sliding fit and to said aerodynamic drag of said rest of the missile, said separation necessitating no active separation means;

an internal space (16) provided between the front part of said power unit and the aft part of said missile; and a communication means establishing communication between the outside of the missile and said internal space.

2. The missile of claim 1 wherein said communication is established through said power unit.

3. The missile of claim 2, in which said power unit has a diameter larger than that of the part of said missile on which it is mounted and in which said part is connected to said power unit by a divergent wall joined thereto, wherein said communication is established through said divergent wall.

4. The missile of claim 1 wherein said communication is multiple.

5. The missile of claim 1 wherein said communication means comprises at least one conduit opening out on the periphery of said missile.

6. The missile of claim 5 wherein said conduit is extended outside said missile by an air vent.

7. The missile of claim 6 wherein said air vent is substantially parallel to the axis of the missile and directed towards the front thereof.

8. The missile of claim 1 wherein seal of said sliding friction fit provides a seal between said front part of said power unit (2) and said aft part of the said rest (3) of said missile, which is effected with the aid of a lubricant.

* * * * *